US011844437B2

(12) United States Patent
Cellard

(10) Patent No.: US 11,844,437 B2
(45) Date of Patent: Dec. 19, 2023

(54) METHOD FOR MANUFACTURING A SEAT AND/OR BACKREST IN TEXTILE COVERING MOUNTED ON A CHAIR TUBULAR CHASSIS AND A CHAIR OBTAINED ACCORDING TO SAID METHOD

(71) Applicant: LAFUMA MOBILIER SAS, Anneyron (FR)

(72) Inventor: Murielle Cellard, Jarcieu (FR)

(73) Assignee: LAFUMA MOBILIER SAS, Anneyron (FR)

( * ) Notice: Subject to any disclaimer, the term of this patent is extended or adjusted under 35 U.S.C. 154(b) by 0 days.

(21) Appl. No.: 17/677,251

(22) Filed: Feb. 22, 2022

(65) Prior Publication Data

US 2022/0265062 A1 Aug. 25, 2022

(30) Foreign Application Priority Data

Feb. 23, 2021 (FR) ..... 21/01751

(51) Int. Cl.

| | |
|---|---|
| ***A47C 31/02*** | (2006.01) |
| ***B68G 7/00*** | (2006.01) |
| ***A47C 5/06*** | (2006.01) |
| ***A47C 5/08*** | (2006.01) |
| ***B68G 7/10*** | (2006.01) |
| ***A47C 7/28*** | (2006.01) |

(52) U.S. Cl.

CPC ..... *A47C 31/023* (2013.01); *A47C 5/06* (2013.01); *A47C 5/08* (2013.01); *A47C 7/282* (2013.01); *B68G 7/00* (2013.01); *B68G 7/10* (2013.01)

(58) Field of Classification Search

CPC ..... A47C 5/06; A47C 5/08; A47C 31/023; B68G 7/00; B68G 7/10; D05B 93/00

See application file for complete search history.

(56) References Cited

FOREIGN PATENT DOCUMENTS

| | | | |
|---|---|---|---|
| AT | 508448 | B1 | 3/2016 |
| DE | 102009059699 | A1 | 8/2010 |
| EP | 2984967 | A1 | 2/2016 |
| JP | 2003159141 | A | 6/2003 |

OTHER PUBLICATIONS

Easy Peasy Creative Ideas, "Sewing Box Corners", Nov. 30, 2017, 1:20-2:00, https://www.youtube.com/watch?v=Ar4O_QHH_bU (Year: 2017).*

* cited by examiner

*Primary Examiner* — Matthew P Travers
(74) *Attorney, Agent, or Firm* — CANTOR COLBURN LLP

(57) ABSTRACT

A method for manufacturing a backrest and/or having a textile covering or the same, and mounted on a chair tubular chassis or the same includes the following steps:

folding the lateral edges of the textile covering and seaming the edges to form lateral sheaths by a lateral seam line, affixing at least three visual markers, (notches), to at least one of the ends of each of the lateral sheaths, a first central notch at the lateral edge of each of the sheaths and two peripheral notches on both sides of the respective central notch, folding the free ends of the sheaths by fitting each central notch between the respective peripheral notches, such that the notches extend facing each other, seaming the free ends of the sheaths at the folding area of the notches by a transverse seam line, and turning over the textile covering by bringing out the corners.

5 Claims, 3 Drawing Sheets

METHOD FOR MANUFACTURING A SEAT AND/OR BACKREST IN TEXTILE COVERING MOUNTED ON A CHAIR TUBULAR CHASSIS AND A CHAIR OBTAINED ACCORDING TO SAID METHOD

CROSS REFERENCE TO RELATED APPLICATIONS

This application is related to and claims the benefit of French Patent Application No. 21/01751, filed on Feb. 23, 2021, the contents of which are herein incorporated by reference in their entirety.

TECHNICAL FIELD

The present disclosure relates to a chair with a seat and/or a backrest in textile covering mounted on a tubular chassis forming a tension frame, and more particularly to a method for manufacturing a seat and/or backrest for such a chair.

BACKGROUND

In the field of chairs, and more particularly in the field of chairs with a textile covering comprising a tubular chassis forming a tension frame and on which a seat and/or a backrest obtained in a textile covering are mounted, it is well known that the textile covering is damaged when it is subjected to repeated impacts, said impacts resulting in ruptures of the fibers of the textile covering which end up by widening due to the tension provided by the tubular chassis.

In order to prevent the threads of knitted fabrics for chair coverings from being cut by external forces, it has already been imagined that the legs of the frame in the endangered area are equipped with a padding made of elastic material, for example a retractable sheath, in order to dampen the effects of the external forces in the form of blows or impacts of the padding and therefore to prevent the threads from being cut directly. This is particularly the case of document DE 10 2009 059 699.

The document EP2984967 is also known, which describes a chair with a backrest made up of a textile covering receiving the clamping frame, which is provided with a support for the textile covering, the clamping frame having a film for protection against the blows by areas, as a support for the textile covering.

Similarly, it is well known that the backrest and/or the seat consists of a textile covering provided with sheaths into which the tubes of the tubular chassis are inserted, the ends of said sheaths being closed by seams. In addition to the unsightly appearance of these seams, the latter tend to break under the effect of the significant forces that apply to said seams, more particularly when a person sits on the chair. Thus, these seams end up yielding leading to a phenomenon known as decladding where the tubes of the chassis protrude from the sheaths rendering the chair unusable.

SUMMARY

One of the aims of the disclosure is therefore to remedy these drawbacks by proposing a method for manufacturing a seat and/or a backrest in textile covering mounted on a chair tubular chassis and a chair obtained according to the method, with a simple and inexpensive design, providing a homogeneous distribution of the forces between the tubes and the textile covering and eliminating the decladding phenomenon.

To this end, and in accordance with the disclosure, there is proposed a method for manufacturing a seat and/or a backrest made of a textile covering or the same, such as a canvas for example, said backrest and/or seat being mounted on a chair tubular chassis or the same, said method is remarkable in that it includes at least the following steps of:

i) folding lateral edges of the textile covering and seaming said folded edges to form lateral sheaths by means of a lateral seam line, ii) affixing at least three visual markers, called notches, to at least one of the ends of each of said lateral sheaths, a central notch being affixed at the lateral edge of each of said lateral sheaths and two peripheral notches being affixed on both sides of the respective central notch, iii) folding free ends of said lateral sheaths by fitting each central notch between the respective peripheral notches and such that said peripheral notches extend facing each other, iv) seaming free ends of the lateral sheaths at the folding area of the notches by means of a transverse seam line, v) turning over the textile covering by bringing out the corners.

It will be observed that this seam closing the ends of the lateral sheaths, and which has a Y-like general shape after turning over the textile covering, provides an homogeneous distribution of the forces of the tubes on the textile covering when a person sits on the chair.

Moreover, in addition to the fact that the method according to the disclosure makes it possible to visually conceal the seam, the method allows avoiding the decladding phenomenon.

Preferably, each central notch is positioned on the lateral edge of the respective lateral sheath and the peripheral notches are positioned equidistant from the respective central notch.

Furthermore, the distance separating the peripheral notches from the respective central notch is 1 cm, said notches being cut directly on the textile covering.

Another advantage of the disclosure relates to a chair comprising a tubular chassis and a seat and/or a backrest made up of a textile covering or the same, such as a canvas for example, mounted on said tubular chassis, in which the backrest and/or the seat is obtained according to the method in accordance with the disclosure.

BRIEF DESCRIPTION OF THE DRAWINGS

Other advantages and features will become clearer from the following description of a single variant, provided as a non-limiting example, of the method for manufacturing a seat and/or a backrest in textile covering mounted on a chair tubular chassis and of the chair obtained according to the method in accordance with the disclosure, with reference to the appended drawings in which.

DETAILED DESCRIPTION OF THE DRAWINGS

Figure 1:
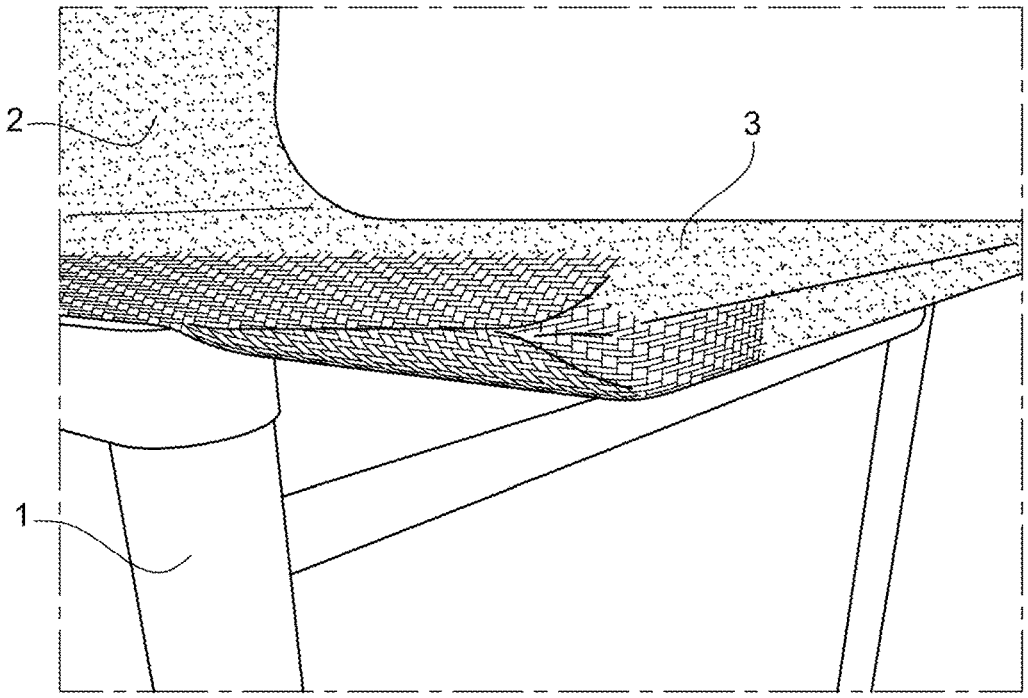
FIG. 1 is a perspective view of a chair comprising a tubular chassis on which a seat and/or a backrest obtained in a textile covering is mounted according to the disclosure.

In the rest of the description of the disclosure, the same reference numerals designate the same elements. The different views are not necessarily plotted to scale.

Referring to FIG. 1, the chair according to the disclosure comprising a tubular chassis 1, a backrest 2 and a seat 3 obtained in a textile covering, such as canvas for example, and mounted on said tubular chassis 1.

In this particular embodiment, the backrest 2 and the seat 3 are obtained as a single piece; however, it is obvious that the backrest 2 and the seat 3 can be obtained in two separate parts without departing from the scope of the disclosure.

Figure 2:
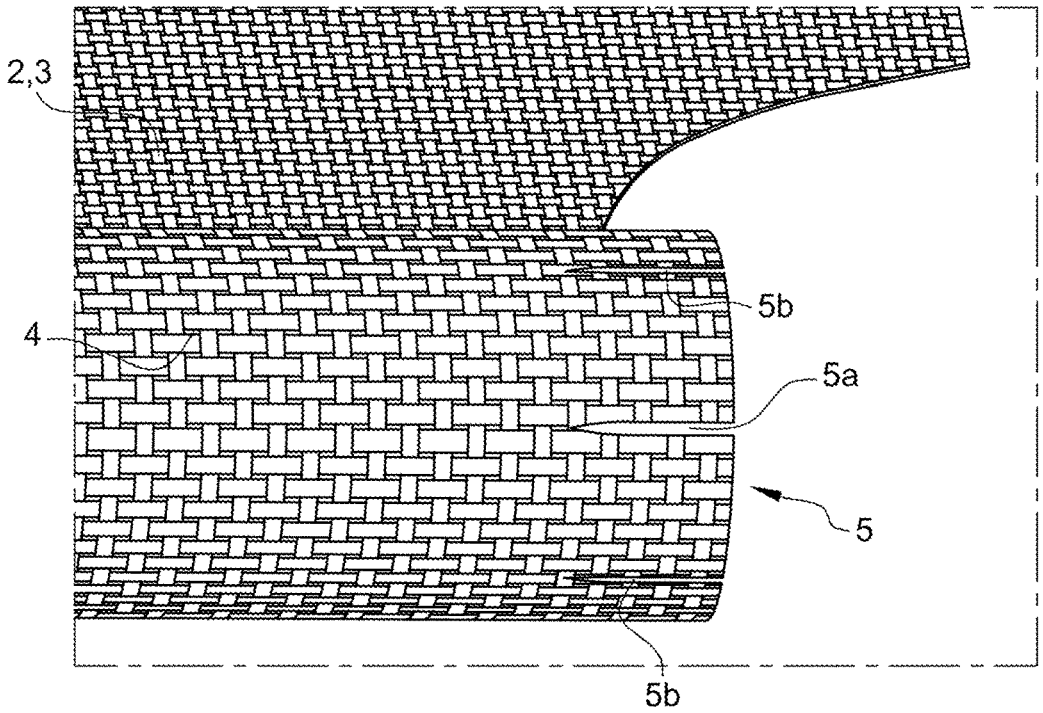
FIG. 2 is a perspective view of the step of affixing notches to the lateral sheaths of the backrest and/or the seat according to the disclosure.

The method for manufacturing the backrest 2 and/or the seat 3 includes, in a first step, with reference to FIG. 2, from a rectangular or square part of a textile covering, in folding the lateral edges of the textile covering and seaming said folded edges to form lateral sheaths 4 by means of a lateral seam line, the lateral seam line being made by means of a seaming machine well known to those skilled in the art.

In a second step, at least three visual markers, called notches 5, are affixed to at least one of the ends of said lateral sheaths 4, a central notch 5*a* being affixed at the lateral edge of the respective lateral sheath 4, and two peripheral notches 5*b* being affixed on both sides of the respective central notch 5*a*. Each central notch 5*a* is positioned on the lateral edge of the respective lateral sheath 4, and the respective peripheral notches 5*b* are positioned equidistant from said central notch 5. Furthermore, the distance separating the peripheral notches 5*b* from the respective central notch 5*a* is 1 cm. In addition, the step of affixing the notches 5, 5*a*, 5*b* includes cutting markers parallel to the lateral edge of the lateral sheaths 4 by means of an automatic cutting.

Figure 3:
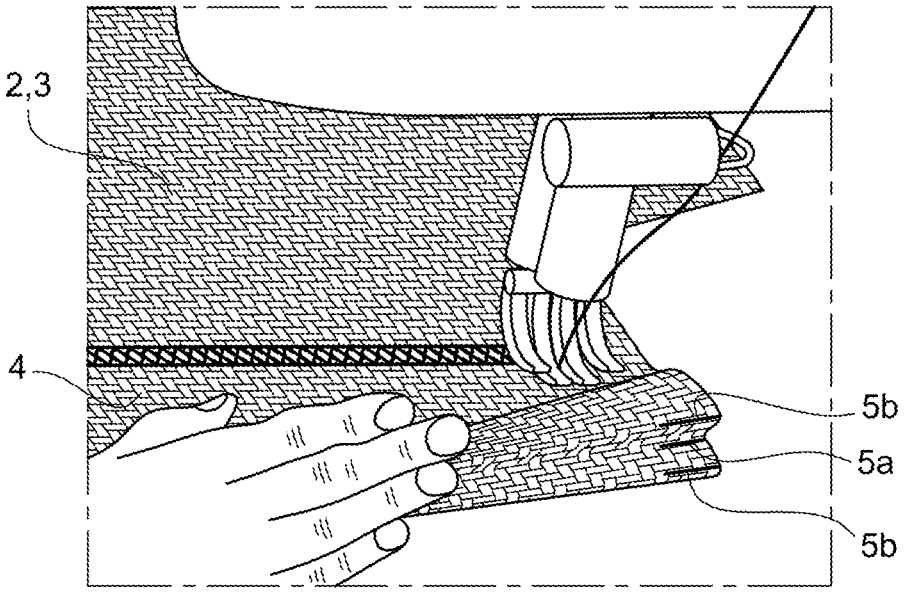
FIG. 3 is a perspective view of folding the lateral sheaths of the backrest and/or the seat according to the disclosure before the step of seaming the end of the lateral sheaths.

The method according to the disclosure, with reference to FIG. 3, then includes folding the free ends of said lateral sheaths 4 by fitting each central notch 5*a* between the respective peripheral notches 5*b* and such that said peripheral notches 5*b* extend facing each other.

Figure 4:
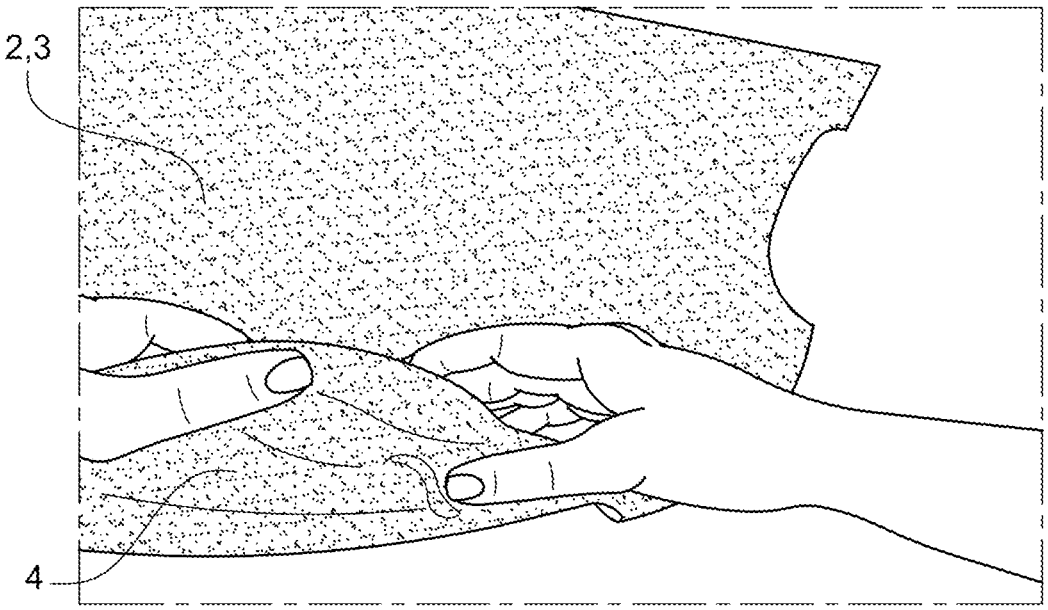
FIG. 4 is a perspective view of the step of turning over the textile covering of the backrest and/or the seat according to the disclosure.
Figure 5:
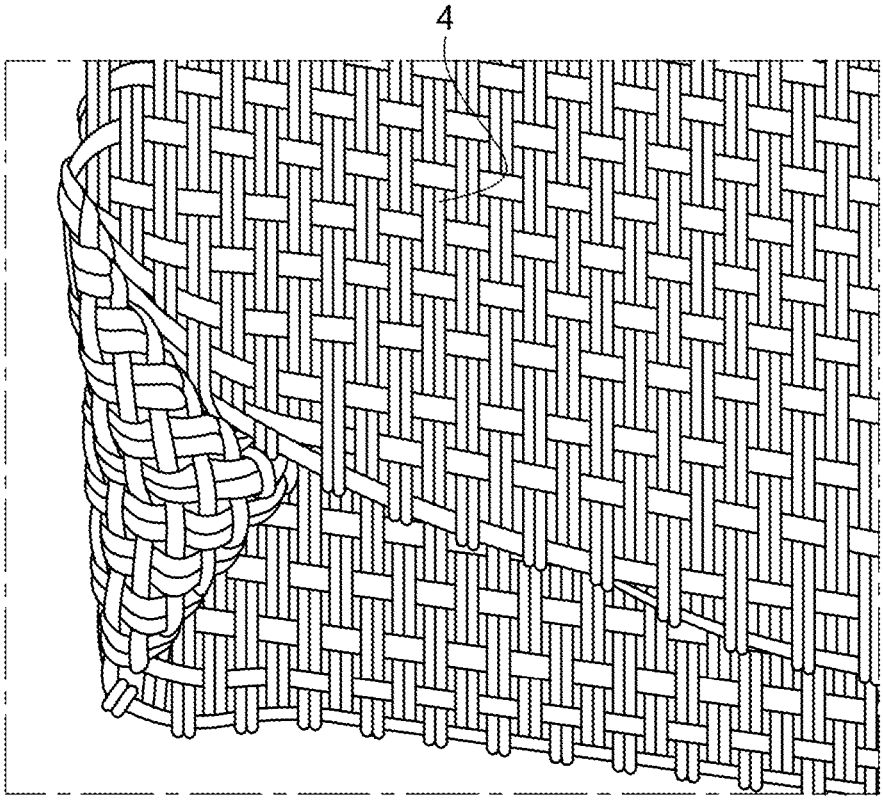
FIG. 5 is a perspective view of the end of the lateral sheaths of the backrest and/or the seat according to the disclosure, once mounted on the tubular chassis of the chair.

Referring to FIG. 3, while maintaining the ends of the lateral sheaths 4 folded, a seaming of said free ends of the lateral sheaths 4 is carried out at the folding area of the notches 5 by means of a transverse seam line, then, with reference to FIG. 4, a turning over of the textile covering is carried out by bringing out the corners to provide a seam (not visible) having a Y-like general shape as shown in FIG. 5.

It will be observed that this seam closing the ends of the lateral sheaths 4, and which has a Y-like general shape after turning over the textile covering, provides a homogeneous distribution of the forces of the tubes of the tubular chassis 1 on the textile covering when a person sits on the chair in particular. Moreover, in addition to the fact that the method according to the disclosure makes it possible to visually eliminate the seam, the method allows avoiding the decladding phenomenon, the seam line not being accessible.

Finally, it is quite obvious that the examples that have just been given are only but particular illustrations which are in no way limiting as to the fields of application of the disclosure.

The invention claimed is:

1. A method for manufacturing a backrest and/or seat comprising a textile covering, said backrest and/or said seat being mounted on a chair tubular chassis, the method including at least the following steps:

i) folding lateral edges of the textile covering and seaming said folded edges to form lateral sheaths by a lateral seam line, ii) providing at least three notches on at least one end of each of said lateral sheaths, the at least three notches provided on each lateral sheath including a central notch provided at a lateral edge of each respective lateral sheath and two peripheral notches provided on two sides of the respective central notch, iii) folding free ends of said lateral sheaths by fitting each central notch between the respective peripheral notches and such that said respective peripheral notches extend facing each other, iv) seaming the free ends at a folding area of the respective central and peripheral notches by a transverse seam line, and v) turning over the textile covering by bringing out corners of the textile covering.

2. The method according to claim 1, wherein each central notch is positioned on the lateral edge of the respective lateral sheath and the peripheral notches are positioned equidistant from the respective central notch.

3. The method according to claim 2, wherein the distance separating the peripheral notches from the respective central notch is 1 cm.

4. The method according to claim 1, wherein the step of providing the notches includes cutting markers parallel to the lateral edges of the respective lateral sheaths by an automatic cutting.

5. A method for manufacturing a backrest and/or seat formed by a textile covering, said backrest and/or said seat being mounted on a chair tubular chassis, the method including at least the following steps:

i) folding lateral edges of the textile covering and seaming said folded edges to form lateral sheaths by a lateral seam line, ii) providing at least three rectilinear visual markers to at least one end of each of said lateral sheaths, the at least three rectilinear visual markers provided on each lateral sheath including a central rectilinear visual marker provided at a lateral edge of the respective lateral sheath and two peripheral rectilinear visual markers provided on two sides of the respective central rectilinear visual marker, iii) folding free ends of said lateral sheaths by fitting each central rectilinear visual marker between the respective peripheral rectilinear visual markers and such that said respective peripheral rectilinear visual markers extend facing each other, iv) seaming the free ends at a folding area of the respective rectilinear visual markers by a transverse seam line, and v) turning over the textile covering by bringing out corners of the textile covering.

* * * * *